United States Patent [19]

Tsunematsu et al.

[11] 3,972,655

[45] Aug. 3, 1976

[54] PUMP PLUNGER ROTATING DEVICE FOR PLUNGER-TYPE FUEL INJECTION

[75] Inventors: Manabu Tsunematsu; Nobuteru Hitomi, both of Yokosuka; Koichi Takahashi, Yokohama, all of Japan

[73] Assignee: Nissan Motor Co., Ltd., Yokohama, Japan

[22] Filed: Aug. 8, 1974

[21] Appl. No.: 496,021

[30] Foreign Application Priority Data

Aug. 16, 1973 Japan ..... 48-95641[U]

[52] U.S. Cl. ..... 417/494; 417/500

[51] Int. Cl.[2] ..... F04B 7/04; F04B 39/10

[58] Field of Search ..... 417/494, 499, 500

[56] References Cited

UNITED STATES PATENTS

| | | | |
|---|---|---|---|
| 1,778,158 | 10/1930 | L'Orange | 417/499 X |
| 2,347,551 | 4/1944 | French | 417/499 |
| 2,482,733 | 9/1949 | Johansson | 417/499 |
| 2,729,168 | 1/1956 | Zleche et al. | 417/499 |

FOREIGN PATENTS OR APPLICATIONS

| | | | |
|---|---|---|---|
| 628,177 | 9/1961 | Canada | 417/494 |
| 1,006,111 | 1/1952 | France | 417/494 |
| 1,178,759 | 12/1958 | France | 417/494 |
| 1,184,664 | 2/1959 | France | 417/494 |
| 690,563 | 4/1953 | United Kingdom | 417/494 |
| 941,784 | 11/1963 | United Kingdom | 417/494 |

*Primary Examiner*—Carlton R. Croyle
*Assistant Examiner*—Richard E. Gluck

[57] ABSTRACT

A slotted bush disposed about and connected by a cotter to a pump plunger is rotatable by a control rod.

1 Claim, 8 Drawing Figures

PUMP PLUNGER ROTATING DEVICE FOR PLUNGER-TYPE FUEL INJECTION

This invention relates to a pump plunger rotating device of a plunger-type fuel injection pump for varying the deliverable quantity of fuel.

It is an object of the present invention to provide an improved pump plunger rotating device which is relatively simple in construction and easy for manufacture, installation, and service thereof.

Another object of the present invention is to provide an improved pump plunger rotating device which does not employ a rack-and-pinion mechanism.

Other objects and advantages of the present invention will become more apparent when considered in connection with the accompanying drawings in which like reference numerals designate corresponding parts and units in some figures in which.

Figure 4A:
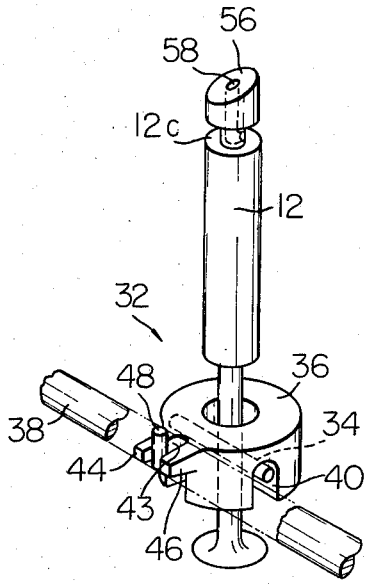
Figure 4B:
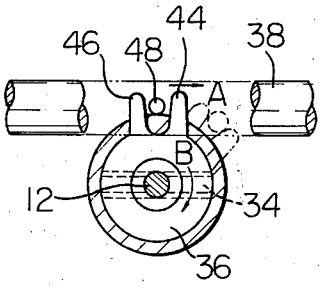

FIG. 4*a* is a perspective view showing an embodiment of a pump plunger rotating device according to the present invention;

FIG. 4*b* is a plan view of FIG. 4*a;*

Figure 5A:
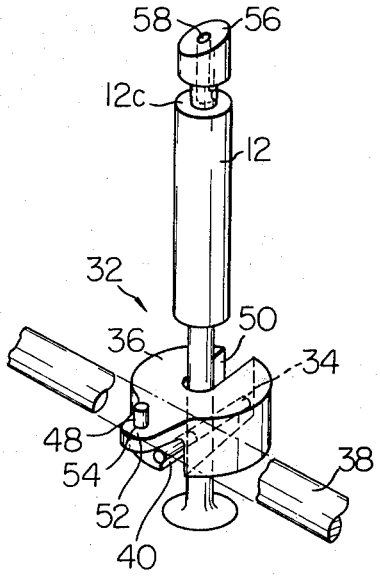
Figure 5B:
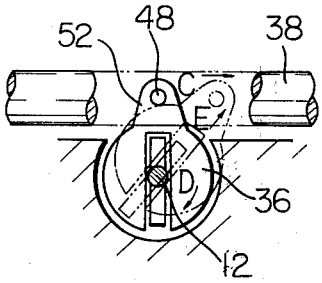

FIG. 5*a* is a perspective view similar to FIG. 4*a*, which view shows another embodiment of a pump plunger rotating device according to the present invention;

FIG. 5*b* is a plan view of FIG. 5*a;* and

Figure 6:
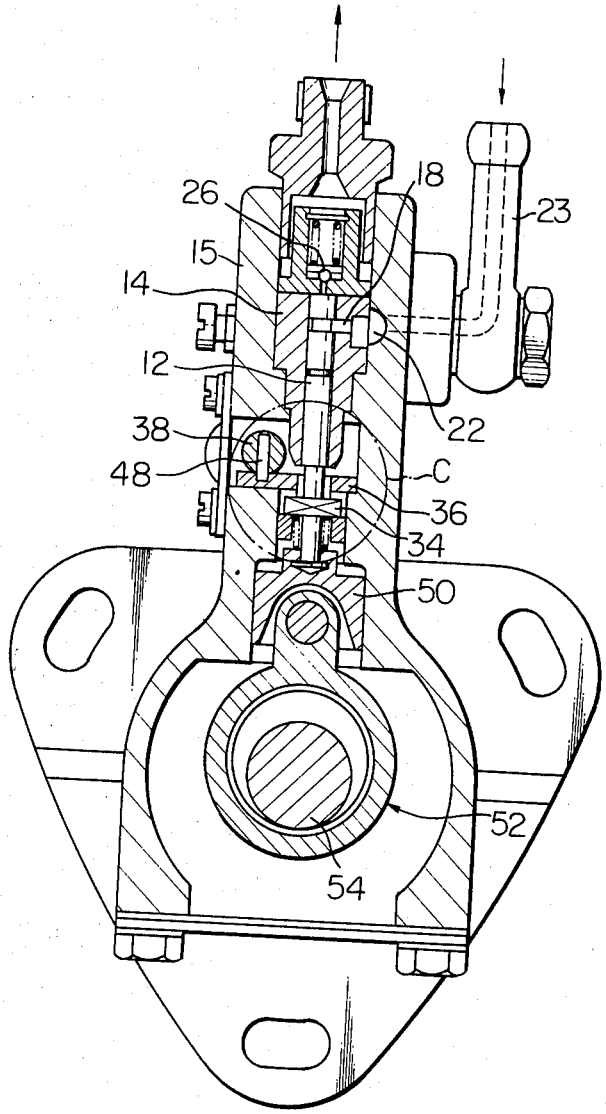

FIG. 6 is a cross-sectional view of a plunger-type fuel injection pump which incorporates an improved pump plunger rotating device according to the present invention.

Figure 1:
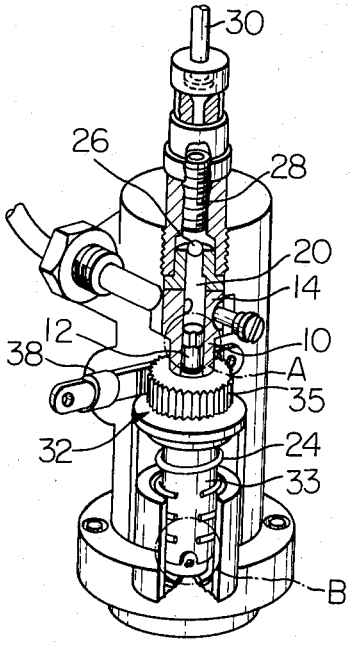
Fig. 1 PRIOR ART
FIG. 1 is a perspective cut away view of a known plunger-type fuel injection pump which incorporates a prior art pump plunger rotating device.
Figure 2:
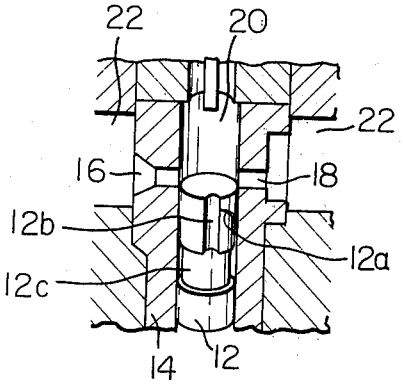
Fig. 2 PRIOR ART
FIG. 2 is an enlarged partial sectional view of the circular section A in FIG. 1.
Figure 3:
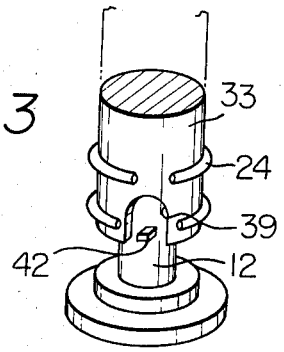
Fig. 3 PRIOR ART
FIG. 3 is an enlarged perspective view of the circular section B in FIG. 1.

Referring now to FIGS. 1, 2 and 3, there is shown a known plunger-type fuel injection pump having a pump element 10 which is made up of a pump plunger 12 and a barrel 14 which is fixedly disposed in a housing 15. The plunger 12 is so accurately fitted into the barrel 14 that it will provide a seal without special packing even at high pressure and low speed. The barrel 14 has a radial intake port 16 and a metering port 18 through which fuel reaches a delivery chamber 20 through a fuel passage 22. During the compression stroke, the pump plunger 12 is moved upwardly by means of cam (not shown). While during the suction stroke, the plunger 12 is moved downwardly by a plunger spring 24. The fuel under pressure in the delivery chamber 20 forces open a delivery valve 26 which is loaded by a valve spring 28 and the fuel is injected through a delivery pipe 30 to a injection nozzle (not shown).

The upper top portion of the pump plunger 12 is milled along a helical line providing a control helix 12*a* to control the quantity of fuel delivered as shown in FIG. 2. In addition the upper portion of the plunger 12 is provided with a longitudinal groove 12*b* and an annular groove 12*c*.

With this arrangement, fuel delivery is accomplished as follows: In the upward movement of the plunger 12, the extreme top surface closes the intake port 16 and the metering port 18 as shown in FIG. 2 and forces fuel through the delivery valve 26 to the delivery pipe 30. Delivery stops as soon as the helix 12*a* and the metering port 18 coincide, as the delivery chamber 20 is from that moment connected to the fuel passage 22 through the longitudinal and annular grooves 12*b* and 12*c*. The fuel is thus forced back into the passage 22. As is apparent from the foregoing, fuel delivery time and quantity are determined by the distance between the extreme top surface and the helix 12*a* of the pump plunger 12. Accordingly, to vary the quantity of fuel delivered by the pump, the pump plunger 12 must be rotated.

As shown, this prior art pump plunger rotating device 32 comprises a control sleeve 33 enclosing the pump plunger 12. On the upper end of the control sleeve 33, a toothed quadrant 35 is clamped. A control rod 38 meshes with the toothed quadrant 35. The control rod 38 is externally connected either to a governor or other controls (not shown) to be moved in response to the engine load. As shown in FIG. 3, at the lower end of the control sleeve 34, an axial groove 39 is formed. A projection 42 on the lower end of the pump plunger 12 is longitudinally slidably inserted in the axial groove 39.

With this arrangement of the prior art pump plunger rotating device 32, rotation of the pump plunger 12 is accomplished as follows: By the movement of the control rod 38, the toothed quadrant 35 meshed with the control rod 38 is rotated. At the same time, the control sleeve 33 rotates and then moves the projection 42 along the periphery of the pump plunger 12. Thus the pump plunger 12 is rotated.

However, since the prior art rotating device uses a rack-and-pinion mechanism, the device has encountered difficulties that the rack-and-pinion requires extremely accurate manufacture, installation and service.

In view of the above difficulties, a pump plunger rotating device of the present invention has been proposed.

Referring now to FIGS. 4*a* and 4*b*, there is shown an embodiment of the pump plunger rotating device 32 of the present invention. The rotating device 32 comprises a cotter 34 which passes through a hole formed substantially at right angles through the pump plunger 12. A cylindrical guide bush 36 surrounds the lower portion of the pump plunger 12. The guide bush 36 has a cotter supporting surface 40 or first means 40 for the cotter 34 in a shape of slot extending in the diameterical direction of the bush 36. In the supporting surface 40, the cotter 34 is supported in such a manner as to be allowed to move along the longitudinal axis of the pump plunger 12 with the plunger 12 which is longitudinally movable, and not to be allowed to move along the longitudinal axis of the cotter 34. The bush 36 has a further elongated guide surface 43 or second means in the form of projections 44 and 46 which project outwardly from the upper side wall. In the guide surface 43, an axial pin 48 is slidably supported. As shown, the axial pin 48 is fixedly attached to a control rod 38 substantially at right angles. The control rod 38 is movable in a direction perpendicular with respect to longitudinal axis of the pump plunger 12. The control rod 38 is externally connected either to a governor or other controls (not shown) to be moved in response to the engine load as in the prior art.

In operation, by movement of the control rod 38 in the direction of an arrow A shown in FIG. 4*b*, the axial pin 48 of the control rod 38 moves the projections 44 and 46 of the bush 36 to the position shown by a broken line. In this step, the axial pin 48 moves outwardly in the radial direction of the bush 36 along the guide surface 43. At the same time, the bush 36 is rotated in the direction of an arrow B shown in FIG. 4*b*. The cotter 34 rotates around the longitudinal axis of the pump plunger with the movement of the bush 36. Such rotation of the cotter 34 causes rotation of the pump plunger 12 in the direction of the arrow B for thereby varying the quantity of fuel delivered.

In FIGS. 5*a* and 5*b*, there is shown another embodiment of a pump plunger rotating device 32 of the present invention. The rotating device 32 comprises a cotter 34 disposed through the lower portion of a pump plunger 12 substantially at right angles. A cylindrical guide bush 36 surrounds the lower portion of the pump plunger 12. The guide bush 36 has a transverse guide surface 40 or first means for the cotter 34 in a shape of slot extending in the diametrical direction of the bush 36. The bush has a further longitudinal guide surface 50 in the shape of slot extending parallel to and coinciding with substantially half of the transverse guide surface 40. A tang 52 extends from the upper side wall of the bush 36. At the central portion of the tang 52, an annular opening 54 having an annular supporting surface or second means therein is formed. In the opening 54, an axial pin 48 is rotatably supported. As shown, the axial pin 48 is fixedly attached to a control rod 38 and intersects substantially at right angles.

In operation, by movement of the control rod 38 in the direction of an arrow C shown in FIG. 5*b*, the axial pin 48 of the control rod 38 moves the bush 36 to the position shown by the broken line. In this step, the bush 36 rotates in the direction of an arrow D and simultaneously slides along the longitudinal axis of the cotter 34 in the direction of an arrow E. Thus the cotter 34 is rotated around the longitudinal axis of the pump plunger 12. Such rotation of the cotter 34 causes rotation of the pump plunger 12 in the direction of the arrow D.

It will be noted that the pump plunger 12 as shown in FIGS. 4*a* and 5*a* has a sloped surface 56 on the extreme top thereof by which the quantity of fuel delivered is varied. At the central portion of the surface 56, an opening 58 is formed. The opening 58 extends along the axis of the pump plunger 12 and communicates with an annular groove 12*c*. The sloped surface 56 serves to vary the quantity of fuel delivered when the plunger 12 is rotated.

With the pump plunger having the sloped surface 56 aforementioned, the quantity of fuel delivered can be varied relatively sinusoidally with the movement of the control rod 38, and the non-linear characteristics of the variation of the fuel delivered is thus decreased. It is also be possible provide linear characteristics by making the characteristics of the governor or other controls linear.

It will be seen that with the arrangement of the pump plunger rotating device 32 according to the present invention, the tangential variation of fuel delivered will be further decreased by increasing the distance between the pump plunger 12 and the control rod 38. The tangential characteristics may be decreased so as to be negligible when the quantity of fuel delivered is decreased by preferably using approximately the middle of the sloped portion of the sine curve obtained with the sloped surface 56 of the pump plunger 12 mentioned above.

FIG. 6 illustrates a plunger-type fuel injection pump which incorporates a pump plunger rotating device of the present invention in the circular section C thereof.

In the figure, the pump plunger 12 is slidably fitted in a barrel 14 which is fixedly disposed in a housing 15 of the pump. The barrel 14 has a fuel intake port 18 which communicates through a fuel passage 22 with a fuel inlet 23. A delivery valve 26 through which fuel is delivered is disposed so as to communicate with the barrel 14 and the plunger 12. The pump plunger 12 has a tappet which is fixed on a guided piston 50. The piston 50 is arranged so as to be moved reciprocatly via a cam or crank 52 and pump crankshaft 54.

In this arrangement of the injection pump, the cotter 34 according to the present invention is disposed through the lower portion of the pump plunger 12. The axial pin 48 according to the present invention is disposed through a control rod 38 which is generally moved perpendicularly with respect to the longitudinal axis of the pump plunger 12. The axial pin 48 operatively connects with the cotter 34 through the guide bush 36 according to the present invention to rotate the pump plunger 12.

It should be understood that the pump plunger rotating device of the present invention does not require a precision machining and manufacture. In addition, since elemental parts of the device according to the present invention are relatively simple in construction, the parts can be easily installed and maintained.

What is claimed is:

1. A fuel injection pump comprising:

a pump plunger having an obliquely inclined top for varying the quantity of fuel delivered by rotation of said plunger about a longitudinal axis thereof;

a control rod movable substantially perpendicularly with respect to the longitudinal axis of the pump plunger in response to the engine load;

a cotter disposed through the pump plunger with its longitudinal axis being substantially at a right angle to the longitudinal axis of said pump plunger;

an axial pin fixedly attached to the control rod and intersecting the control rod substantially at a right angle thereto; and a cylindrical guide bush including first means for movably supporting said cotter and second means for movably supporting said axial pin, whereby movement of said guide bush and said cotter and thereby rotate said pump plunger about its longitudinal axis, said plunger being enclosed in a cylinder, said inclined top surface cooperating with port means in said cylinder in order to vary the quantity of fuel delivered as a function the plunger's position about its longitudinal axis, said first means slidably supports said cotter along the longitudinal axis of the cotter, and said second means rotatably supports said axial pin, said first means includes a guide surface in the shape of a slot extending along the diametrical direction of said guide bush, an additional slot in said guide bush extending in a direction parallel to the longitudinal axis of said plunger, said diametrical and additional slots cooperating for allowing said guide bush to move along the longitudinal axis of said cotter, and said second means includes an annular supporting surface formed in the shape of opening in a tang extending from said guide bush for rotatably supporting said axial pin.

* * * * *